US007230546B1

(12) United States Patent
Nelson et al.

(10) Patent No.: US 7,230,546 B1
(45) Date of Patent: Jun. 12, 2007

(54) ROADWAY INCURSION ALERT SYSTEM

(76) Inventors: Craig Nelson, 9879 Turtle Dove Ct., Elk Grove, CA (US) 95828; Robert Bos, 203 Baldwin Ave., Roseville, CA (US) 95624

( * ) Notice: Subject to any disclaimer, the term of this patent is extended or adjusted under 35 U.S.C. 154(b) by 254 days.

(21) Appl. No.: 11/031,966

(22) Filed: Jan. 6, 2005

Related U.S. Application Data

(63) Continuation-in-part of application No. 10/289,230, filed on Nov. 5, 2002, now Pat. No. 7,030,777.

(60) Provisional application No. 60/534,615, filed on Jan. 6, 2004, provisional application No. 60/337,035, filed on Nov. 6, 2001.

(51) Int. Cl.
*G08G 1/01* (2006.01)

(52) U.S. Cl. ..... 340/933; 340/907; 340/908; 340/908.1; 340/940

(58) Field of Classification Search ..... 340/933, 340/940, 907, 908, 908.1
See application file for complete search history.

(56) References Cited

U.S. PATENT DOCUMENTS

| | | | | |
|---|---|---|---|---|
| 2,099,868 | A | 11/1937 | Sing et al. | |
| 3,488,651 | A | 1/1970 | Brenner | |
| 3,660,817 | A | 5/1972 | Abrams | |
| 3,771,123 | A | 11/1973 | Lanes | |
| 4,825,211 | A | 4/1989 | Park | |
| 4,951,045 | A | 8/1990 | Knapp et al. | |
| 4,998,093 | A | 3/1991 | Benoit | |
| 5,083,200 | A | 1/1992 | Deffontaines | |
| 5,128,670 | A | 7/1992 | Jackson et al. | |
| 5,175,529 | A | 12/1992 | St. Clair | |
| 5,265,556 | A | 11/1993 | Hall | |
| 5,281,964 | A | 1/1994 | Iida et al. | |
| 5,294,924 | A | 3/1994 | Dydzyk | |
| 5,378,865 | A | 1/1995 | Reneau | |
| 5,457,449 | A | 10/1995 | Kuning et al. | |
| 5,512,891 | A | 4/1996 | Kang | |
| 5,577,824 | A | 11/1996 | Wright | |
| 5,661,474 | A | 8/1997 | Douglas | |
| 5,760,686 | A | 6/1998 | Toman | |
| 5,900,826 | A | 5/1999 | Farber | |
| 6,075,450 | A | 6/2000 | Clark | |
| 6,137,424 | A * | 10/2000 | Cohen et al. | 340/933 |
| 6,288,651 | B1 | 9/2001 | Souza | |
| 7,030,777 | B1 * | 4/2006 | Nelson et al. | 340/933 |

FOREIGN PATENT DOCUMENTS

| | | |
|---|---|---|
| GB | 1503574 | 3/1978 |

* cited by examiner

*Primary Examiner*—Julie Bichngoc Lieu
(74) *Attorney, Agent, or Firm*—John P. O'Banion

(57) ABSTRACT

An apparatus and method for generating incursion alerts in response to incursion events detected by incursion detector units, attached to safety icons such as traffic cones and signage. The incursion detector units are activated by automatic activation sensors and remain activated for a period of time. Alerts are generated in response to impacts detected at the safety icons by an incursion detector and transmitted to one or more incursion receiver units which annunciate the alert with audio, lights, or tactile output to warn personnel of possibly impending danger. Alert signals are preferably repeated by other incursion detectors wherein the distance and conditions over which the alert signals may be communicated is extended. A validation circuit and tilt sensor filter out not incursion events such as wind tipping. The incursion detectors may generate area alerts, or personal alerts and can transmit operational status and alerts to discrete groups of receivers.

27 Claims, 8 Drawing Sheets

ROADWAY INCURSION ALERT SYSTEM

CROSS-REFERENCE TO RELATED APPLICATIONS

This application is a continuation-in-part of application Ser. No. 10/289,230 filed on Nov. 5, 2002 now U.S. Pat. No. 7,030,777, incorporated herein by reference in its entirety, which claims priority from U.S. provisional application Ser. No. 60/337,035 filed on Nov. 6, 2001, incorporated herein by reference in its entirety. This application also claims priority from U.S. provisional application Ser. No. 60/534,615 filed on Jan. 6, 2004, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

The present invention pertains generally to traffic safety devices, and more particularly to a method and system that provides remote alerts to roadway personnel in response to traffic incursions.

2. Description of Related Art

Protecting road construction personnel from injuries that arise from vehicles straying from marked roadway boundaries or directives provided by safety icons has long been a high priority of various transportation organizations. It should be appreciated that safety icons may be provided in any of a number of different forms, including signage, safety barricades, safety barrels, safety nets, safety fences, traffic cones, traffic posts and so forth that are configured for directing traffic flow or displaying work site related warning signage and information. A number of systems have been developed toward fulfilling the goal of warning construction workers when a vehicle incursion occurs in association with these safety icons. For example, a number of light and sound devices have been proposed which attach to a traffic safety cone, or similar safety icon, for generating an alerting annunciation, such as light or sound, to warn construction personnel of a hazard when the safety icon is struck by a vehicle. Existing incursion devices may only be adapted to one type of safety icon or have a limitation such as range or line of sight for transmitting a warning signal.

Unfortunately, construction sites are often extremely high noise environments in which alerting sounds, and/or lighting, positioned more than a few yards away may not be noticed by busy construction crews. Further exacerbating the alert cognition problem, many workers wear noise attenuating hearing protection to minimize the noise hazard to which their ears are subjected.

As sound and light are attenuated in free space according to the square of the distance, it is also not surprising that the sound (or light) generated from an alert unit may only be recognized by personnel positioned within a short distance of the alert unit. The distance over which the warning may be heard, or seen, may be insufficient to allow workers to determine the cause of the alert and to extract themselves and others from danger. As a result, even with incursion detectors available, many workers are struck by oncoming vehicles every year. Personal pager systems that generate an audio, optical or vibratory signal have been developed as personal safety receivers to be worn on the worker. To be effective, however, the system must reliably receive the incursion signal. Distance, line of sight, and interference from equipment or structures are limitations of existing incursion detectors that must be taken into account when deploying these systems. False signals also decrease effectiveness of these systems.

Worker safety also depends on proper deployment of the incursion device. Connections and switches are susceptible to human error or accidental deactivation. Deployment is typically done at the start of each work day. Extra time required to position and verify operation of existing safety devices further exposes workers to traffic hazards and lowers project productivity.

It should be appreciated that a number of causes may exist for highly erratic driving, for example the driver may be inept, out of control, intoxicated, asleep, in the throes of a physical situation (heart attack, stroke, and so forth), homicidal, suicidal, or combinations thereof along with other similar dangerous states of mind and/or body. Consequently, since existing systems can only reliably communicate warnings over a short distance, road construction personnel are subject to increased risk of injury or death.

Therefore, a warning system is needed that is capable of providing reliable incursion alerts to roadway personnel sufficiently in advance of when the oncoming vehicle poses a threat to construction workers located near the incursion or at any desired distance therefrom. An incursion alert warning system that is quick and easy to deploy, adaptable to many existing safety icons, does not depend on line of sight, does not depend on operator activation and can protect extended construction zones is desired.

BRIEF SUMMARY OF THE INVENTION

The present invention is a roadway incursion system for generating incursion alerts to individuals that may be located near the site of the incursion. The roadway alert system of the present invention generally comprises: (1) one or more incursion transmitter devices for communicating an alert signal in response to incursion, such as in response to incursion induced impact registration, or other form of detected incursion; (2) one or more incursion receivers which annunciate the received alert, such as by employing acoustic outputs, optical outputs, physically indicated alerts (i.e. "pop-up" flags or similar), tactile outputs, such as vibratory pagers, or combinations thereof.

The incursion detection devices are adapted to detachably couple to structures or safety icons that may be positioned proximal to a roadway, and they communicate with one or more remote receivers over a wireless communications link. It will be appreciated that a wireless link allows for the flexible placement of the incursion detection units without concern for cord routing.

Considering a wireless implementation the devices may communicate using any desired form of communication link, such as within the electromagnetic radiation spectrum (i.e. radio, light), or acoustics (i.e. ultrasound). Since radio frequency communication is readily available and inexpensive it will be generally described herein, although it should be remembered that alternate forms of communication linkage may be utilized without departing from the teachings of the present invention.

Each incursion detector unit may be implemented as either a transmitter or a transceiver. Implementing an incursion detection device as a transceiver can provide additional benefits, wherein selective repeating of the incursion alert signals from other incursion transmitters or transceivers toward at least one incursion receiver unit can be performed to extend the range of communication. Using transceiver units as repeaters is beneficial in that the incursion detectors reporting an alert signal to a receiver may span an extended distance while being less subject to signal loss because of terrain, line of sight or other obstructions. Although the devices may be implemented as either transmitter units or transceiver units, the incursion sensing devices will be herein referred to as incursion detectors.

Optionally, the incursion detectors may include a local area alert device, such as a light output, or sound, making it easier for workers to determine which incursion detector is generating, or generated, a particular alert as annunciated by an incursion receiver unit.

The incursion detectors employ an incursion detector coupled with a transmitter or transceiver which remotely communicates incursions to additional transceivers and to a remote receiver. Incursion detectors may be positioned near roadway surfaces either as separate integrated units or attached to other roadway elements, such as traffic icons which may comprise signage, traffic cones, traffic posts, traffic barricades, fences, attenuators, and so forth. The transceivers may be configured to detect an incursion in response to an incursion related impact whose force is detected by the transceiver, or the incursion detectors may be configured to detect remote incursion events. For example, one form of incursion detector can be integrated within, or attached to, traffic barricades and similar devices, to register and transmit alerts associated with impact.

By way of example and not of limitation, each incursion detector may comprise an impact sensor, a signal processing means, a control circuit, and a transceiver. The operational functions and features of the units may be readily controlled by conventional control circuitry, such as firmware executing on an inexpensive microcontroller. The incursion receiver unit may be configured to annunciate alarms to personnel within a given area, wherein it is generally referred to herein as an area alert system or area alarm. The incursion receiver unit may also be implemented as individual "personal receivers" such as headsets or personal pager style devices that generate alerts to each individual wearing the device. It will be appreciated that a receiver unit retained on an individual may also be configured to generate an area alert, such as headset, or pager, that is adapted with an external area annunciator (i.e. acoustic and/or light) output. The area alarm and personal receivers may be utilized separately or in combination with one another.

Although the invention has been described in terms of an incursion alert device, it is contemplated that other embodiments may be configured for use in security and safety situations other than near roadways. For example, attached to and detecting movement or vibration at security fences, equipment, doors or windows. It is further contemplated that external sensors or circuits may be connected to other embodiments of the device for further beneficial uses.

An embodiment of the invention is an apparatus for detecting an incursion event and alerting a receiving device that comprises an impact detector adapted to detect an incursion event and generate an impact signal, means for transmitting an alert signal to a receiving device in response to detection of an incursion event by the impact detector, and means for automatically activating the impact detector, where the means for automatically activating responds to a change in ambient light, where the impact detector cannot be switched off for a predetermined interval of time after activation by the means for automatically activating.

Another aspect of the invention is where the means for automatically activating comprises a photo sensor.

A further aspect of the invention is where the means for transmitting comprises a validation circuit adapted to receive an impact signal from the impact detector and verify that an impact corresponding to an incursion event has occurred, where the validation circuit is further adapted to generate an alert signal when an incursion event has occurred, a transmitter connected to the validation circuit, where the validation circuit is further adapted to communicate the alert signal to the transmitter for transmission to a receiving device.

A still further aspect of the invention is a battery where the battery functions as an antenna for the transmitter.

Another aspect of the invention is where the means for transmitting further comprises a forwarding receiver adapted to receive an alert signal from another alert apparatus and communicate the alert signal to the transmitter for transmission to a receiving device.

A further aspect of the invention is where the means for transmitting further comprises an encoder coupled to the validation circuit where the encoder is adapted to encode the alert signal from the validation circuit.

A still further aspect of the invention is a tilt sensor connected to the validation circuit where the tilt sensor is adapted to detect a change in orientation of the impact detector.

Another aspect of the invention is here the validation circuit will not generate an alert signal when a change in orientation is detected by the tilt sensor immediately prior to an impact detected by the impact detector.

A further aspect of the invention is where the means for transmitting further comprises a forwarding receiver adapted to receive an alert signal from another alert apparatus and communicate the alert signal to the transmitter for transmission to a receiving device.

A still further aspect of the invention is where the impact detector comprises a piezoelectric sensor that generates a voltage signal in response to an impact.

Another aspect of the invention is where the validation circuit comprises a voltage threshold filter that is adjustable and configured for selectively filtering non-impact signals from the piezoelectric sensor, and a frequency filter that is adjustable and configured for selectively filtering non-impact signals from the piezoelectric sensor of a predetermined frequency.

A further aspect of the invention is where the impact detector is adapted to attach to a safety icon selected from the group consisting essentially of traffic cones, traffic posts, safety barricades, safety barrels, safety nets, attenuators, pylons and safety fences.

Another embodiment of the invention is an apparatus for detecting an incursion event and alerting a receiving device that comprises an impact detector adapted to generate an impact signal in response to detecting an incursion event, a validation circuit adapted to receive the impact signal from the impact detector and verify that an impact corresponding to an incursion event has occurred, where the validation circuit is further adapted to generate an alert signal when an incursion event has occurred, a transmitter connected to the validation circuit, where the validation circuit is further adapted to communicate the alert signal to the transmitter for transmission to a receiving device, a tilt sensor connected to the validation circuit, where the tilt sensor is adapted to detect a change in orientation of the impact detector, and where the validation circuit will not generate an alert signal when a change in orientation is detected by the tilt switch immediately prior to an impact detected by the impact detector.

Another aspect of the invention is an automatic activation switch coupled to the impact detector, where the automatic activation switch responds to ambient light, and where the impact detector cannot be switched off for a predetermined interval of time after activation by the automatic activation switch.

A further aspect of the invention is where the automatic activation switch comprises a photo sensor.

A still further aspect of the invention is where the impact detector comprises a piezoelectric sensor that generates a voltage signal in response to an impact.

A yet further aspect of the invention is where the validation circuit comprises a voltage threshold filter that is adjustable and configured for selectively filtering non-impact signals from the piezoelectric sensor, and a frequency filter that is adjustable and configured for selectively filtering non-impact signals from the piezoelectric sensor of a predetermined frequency.

Another aspect of the invention is a forwarding receiver adapted to receive an alert signal from another alert apparatus and communicate the alert signal to the transmitter for transmission to a receiving device.

A further embodiment of the invention is an apparatus for alerting personnel to an incursion event that comprises an impact detector adapted to generate an impact signal in response to detecting an incursion event, a validation circuit adapted to receive the impact signal from the impact detector and verify that an impact corresponding to an incursion event has occurred, where the validation circuit is further adapted to generate an alert signal when an incursion event has occurred, a transmitter connected to the validation circuit, where the validation circuit is further adapted to communicate the alert signal to the transmitter, a tilt sensor connected to the validation circuit, where the tilt sensor is adapted to detect a change in orientation of the impact detector, where the validation circuit will not generate an alert signal when a change in orientation is detected by the tilt switch immediately prior to an impact detected by the impact detector, and a personal receiver adapted to receive a coded alert signal from the transmitter, where the personal receiver is further adapted to annunciate an alert when the coded alert signal is received from the transmitter.

Another aspect of the invention is an area alert receiver adapted to receive a coded alert signal from the transmitter, where the area alert receiver is further adapted to annunciate an alert when the coded alert signal is received from the transmitter.

A further aspect of the invention is a first transceiver coupled to the personal receiver, a second transceiver coupled to the area alert receiver, where the first transceiver is adapted to interrogate the second transceiver in the area alert receiver, and where the second transceiver is adapted to respond to interrogation from the first transceiver in the personal receiver with a code for the coded alert signal.

A still further aspect of the invention is where the personal receiver is configured to receive the coded alert signal from the transmitter after receiving the code from the area receiver.

Another embodiment of the invention is a method of detecting incursion events and generating incursion alerts that comprises providing an incursion detector with an impact sensor, a validation circuit, a transmitter and an automatic activation sensor, activating the incursion detector with the automatic activation sensor, detecting an impact with the impact detector, validating the impact is an incursion event with the validation circuit, generating an alert signal in response to the incursion event, and communicating the alert signal with the transmitter to a receiver configured for annunciating the alert signal corresponding to the incursion event.

A further aspect of the invention is coupling a tilt sensor to the incursion detector, detecting a change in orientation of the incursion detector by the tilt sensor, and preventing communication of an alert signal when the tilt sensor detects a change in orientation of the incursion detector prior to an impact.

A still further aspect of the invention is providing a forwarding receiver coupled to the transmitter, receiving an alert signal from another incursion detector by the forwarding receiver, and communicating the alert signal with the transmitter to a receiver configured for annunciating the alert signal corresponding to the incursion event.

Another aspect of the invention is temporarily discontinuing alert signal transmissions for a second period of time following a first period of time during which the alert signal is communicated to a receiver.

A further aspect of the invention is providing an encoder in the validation circuit, and encoding the alert signal communicated to a receiver configured for annunciating the alert signal corresponding to the incursion event.

A still further aspect of the invention is maintaining activation of the incursion detector for a predetermined period of time after activation by the automatic activation sensor.

Another embodiment of the invention is a method of detecting incursion events and generating incursion alerts that comprises providing an incursion detector with an impact sensor, a validation circuit, a transmitter and a tilt sensor, detecting an impact with the impact detector, validating the impact is an incursion event with the validation circuit, generating an alert signal in response to the incursion event, and communicating the alert signal with the transmitter to a receiver configured for annunciating the alert signal corresponding to the incursion event.

Another aspect of the invention is detecting a change in orientation of the incursion detector by the tilt sensor and preventing communication of an alert signal when the tilt sensor detects a change in orientation of the incursion detector prior to an impact.

A further aspect of the invention is providing a forwarding receiver coupled to the transmitter, receiving an alert signal from another incursion detector by the forwarding receiver, and communicating the alert signal with the transmitter to a receiver configured for annunciating the alert signal corresponding to the incursion event.

A still further aspect of the invention is temporarily discontinuing alert signal transmissions for a second period of time following a first period of time during which the alert signal is communicated to a receiver.

Another aspect of the invention is providing an automatic activation sensor for the impact detector, activating the impact detector with the automatic activation sensor, and maintaining activation of the incursion detector for a predetermined period of time after activation by the automatic activation sensor.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 8. It will be appreciated that the apparatus may vary as to configuration and as to details of the parts, and that the method may vary as to the specific steps and sequence, without departing from the basic concepts as disclosed herein.

Figure 1:
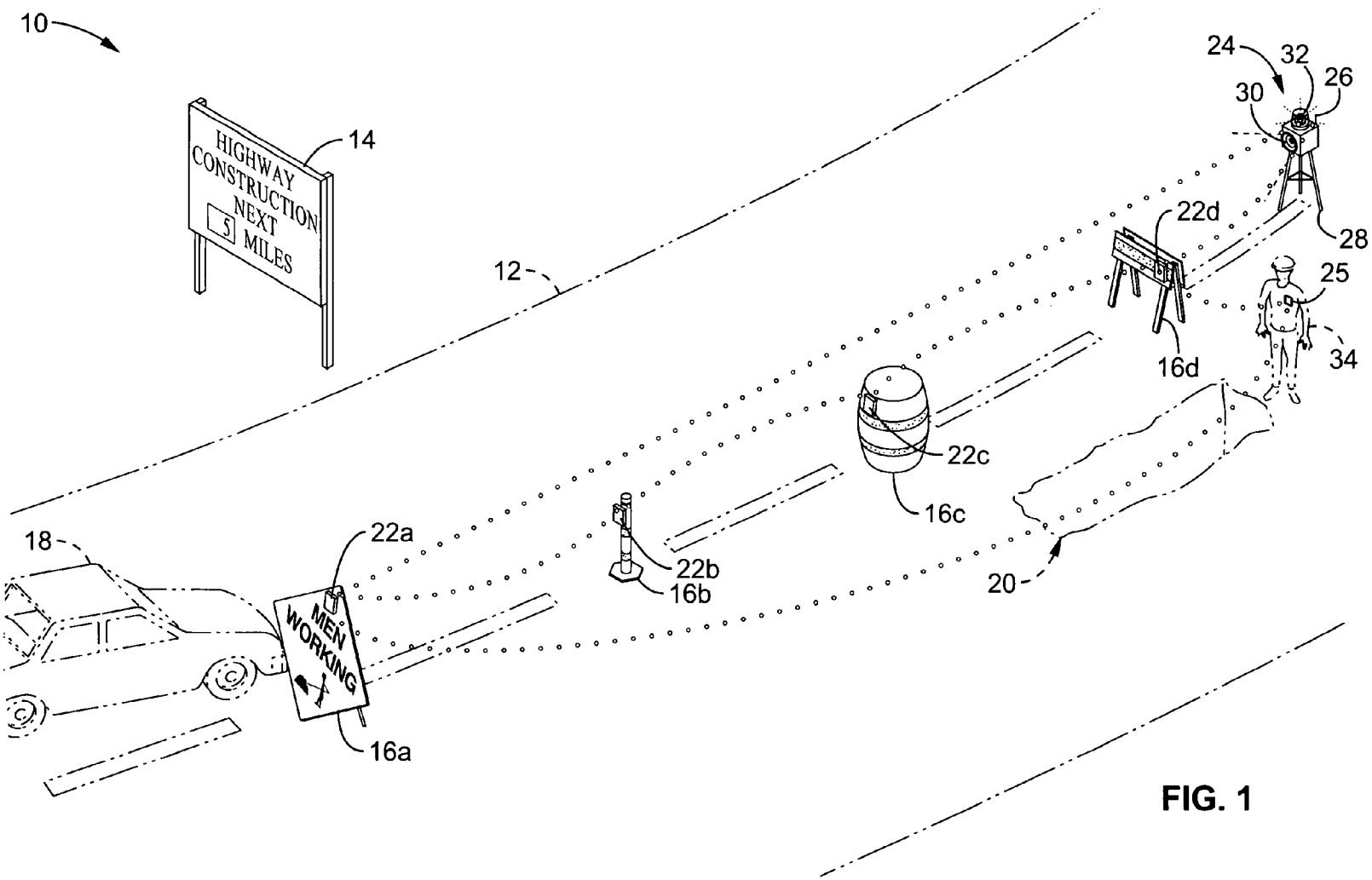
FIG. 1 is a schematic view of a roadway situation in which an incursion alert system according to an embodiment of the present invention is shown for alerting personnel, such as roadway construction workers, in response to the danger associated with remotely detected incursions.

FIG. 1 exemplifies a typical roadway construction situation 10, showing a roadway 12 with a construction sign 14 and a series of traffic icons 16*a*–16*d* blocking off a closed lane. Icon 16*a* is a roadway sign, 16*b* is a pylon, 16*c* is a traffic barrel and 16*d* is a barricade and are examples of typical safety icons for routing and controlling vehicular traffic. In this situation, a vehicle 18 is shown impacting traffic icon 16*a*, which may be considered as an incursion of the vehicle into the closed lane providing a safety zone for the roadway workers near construction area 20. Usually such incursions are the result of a driver being slightly off-course, however, an erratic or impaired driver may cross over and continue on a course toward the construction crew.

It will be appreciated that such hazards may arise from a number of different arrangements and situations in which safety icons provide demarcation of traffic flow paths. Typically, the present invention would be utilized to provide a warning to workers in an area near these safety icons in response to the detection of incursions, such as that depicted in FIG. 1. The present invention detects an incursion within an incursion unit 22. A series of incursion units 22*a* through 22*d* are depicted in FIG. 1 mounted to a series of safety icons, exemplified in 16*a* through 16*d*. The incursion detectors 22*a* through 22*d* are depicted being utilized with common forms of safety icons 16*a* through 16*d* utilized for separating traffic from roadway crews. Each incursion detector unit 22 is preferably retained within a housing that is configured for being removably mounted to a safety icon, such as by using a spring clip, strap, harness, or hook and loop fabric. It will be readily appreciated that any convenient mounting methodology may be utilized for attaching the incursion units 22 to a safety icon.

Alternatively, the incursion detection units may be integrated within safety icons, integrated within other devices to provide incursion detection, or mounted separately to detect remote incursions.

Each incursion unit 22*a* through 22*d* is configured to transmit alert signals over a distance, such as by radio frequency transmission or similar communication mechanism, to an alert receiver unit 24 and a personal receiver 25. A series of dots represent the communication signal path between nearby incursion units 22*a* through 22*d*, and between transceiver units 22*a* through 22*d* and the alert receiver unit 24 and personal receiver 25. For the sake of clarity only one path from transceiver unit 22*a* to alert receiver 24, personal receiver 25, and between successive incursion units is depicted. It should be appreciated, however, that each incursion can function as a repeater and communicate with other transceiver units within its range as well as one or more receiver units.

The incursion alert receiver 24 and personal receiver 25 responds to these transmissions by annunciating alerts to personnel 34. The present invention may be implemented to generate both area alerts and individual alerts, such as noise attenuating headsets and pager style devices.

The area alerting receiver unit 24 is configured within this embodiment to annunciate area alerts to personnel in response to signals received on antenna 26. The area alerting receiver unit 24 may also be referred to herein as an area alert system or area alarm. Preferably, receiver unit 24 is supported on a base 28 which retains the unit above the ground for improved sound dissemination and increased light source visibility. Alerts may be annunciated as an audio output, signaling lights, physical output (i.e. "pop-up" flags), tactile output (haptic output), or combinations thereof. Personal receiver 25 can be adapted to provide optical, auditory or vibratory signals to the wearer.

In the present embodiment, area alarm unit 24 is configured for generating both a loud audio warning signal from audio transducer 30, and a bright flashing light generated by signaling light 32. The remote signaling capability increases the likelihood that a roadway construction worker 34 will hear and see the alert even if it is generated from a remote incursion, wherein increased maneuvering time is provided for protecting themselves and others. Additionally, the area alarm 24 may be coupled with or incorporated within existing equipment, such as within radar-equipped vehicle speed annunciating signage, or other devices.

Figure 2:
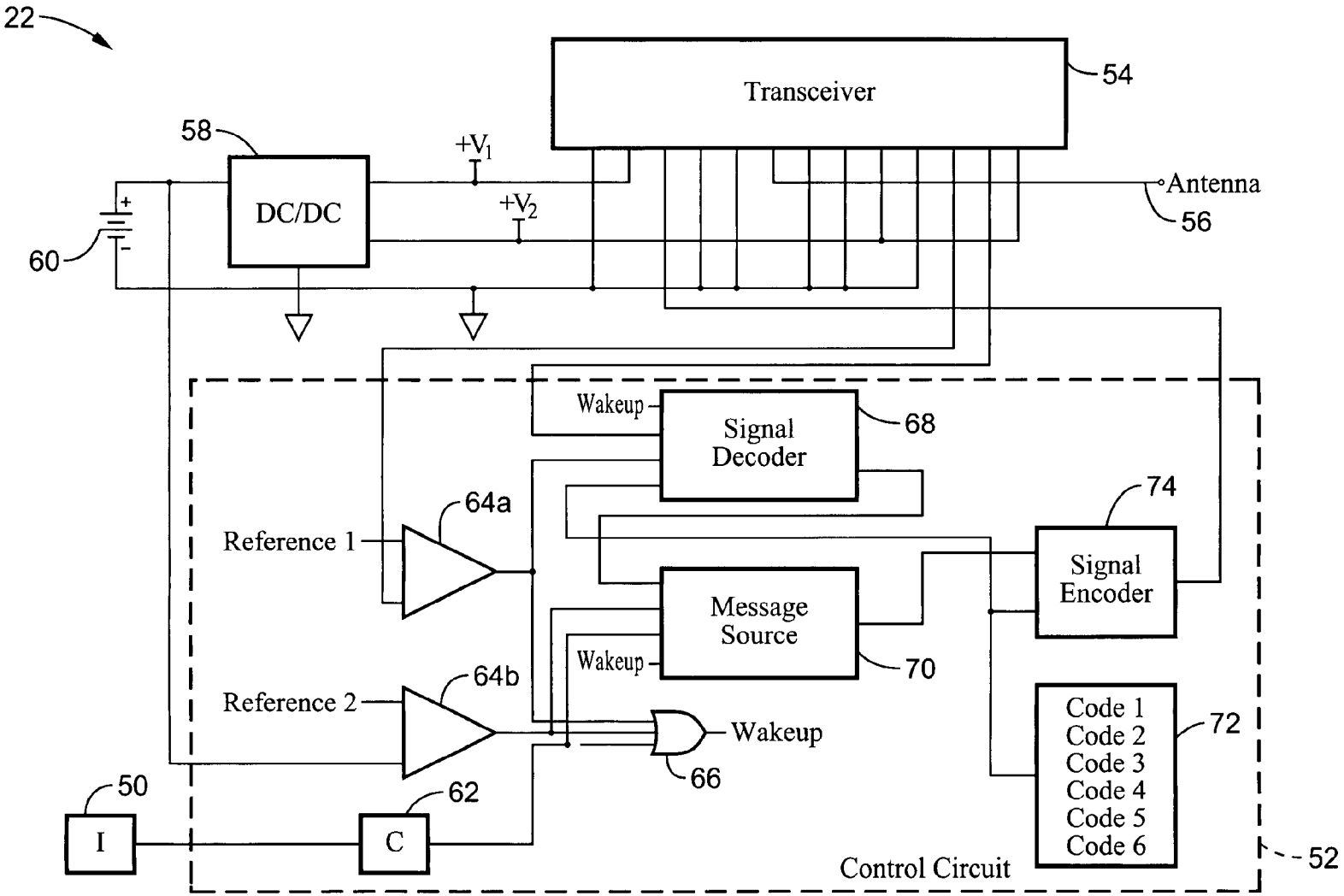
FIG. 2 is a simplified schematic view of an incursion detector unit according to an embodiment of the present invention shown for detecting impacts as incursion events.

FIG. 2 exemplifies an incursion 22 which is configured to detect and broadcast impact events as incursion transmissions. The transceiver of the present invention is preferably configured for retransmitting incursion events broadcast by other nearby incursion detectors. Incursion detector 22 generally comprises a housing (not shown) within which are retained an incursion detector 50, control circuit 52, transceiver 54, antenna 56, a voltage regulator 58, and power source 60, such as a battery. An automatic power switch (not shown) is preferably provided to activate the unit when in use. It should be appreciated that incursion detector 22 may be positioned for use in any of a number of desired configurations, including: (1) standalone use; (2) having a housing configured for mounting to a structure, such as a safety icon; (3) integrated within a safety icon, or other structure.

Incursion detector 50 may comprise any form of sensor capable of registering incursion. A common and easily detected form of incursion arises when a vehicle strikes a safety icon, wherein impact registration can be utilized as an indicator of incursion. By way of example, pressure sensors, impact sensors, tilt sensors, motion sensors, force sensors, speed sensors, distance sensors, rate of rotation sensors, vibration sensors, or acceleration sensors, may be utilized to detect impacts associated with incursion events. These sensors may comprise simple switch type devices or comprise one or more sensing elements coupled with signal conditioning and/or processing circuitry. The sensor may be implemented using any convenient technologies and fabrication processes including piezoelectric, MEMs, and so forth. It will be appreciated that in many applications, the response of the sensor need not provide high accuracy or a linear output.

Piezoelectric thick film vibration sensors are generally preferred for impact sensor 50 because of their analog voltage signal output and inherent low cost. An example of one such sensor is model "0-1002794-1 Switch/Vibration Sensor" manufactured by Measurement Specialties™ of Valley Forge, Pa. This device comprises a thin piezoelectric PVDF film laminated to a flexible planar substrate. One end of the substrate is attached (i.e. through its two electrical contacts) while the other end is free to move in a cantilevered single axis manner in response to impact vibrations or accelerations. The baseline sensitivity of this particular sensor may be varied from approximately 50 mV/g to approximately 800 mV/g by adding small masses to the free end of the sensor. An advantage of a piezoelectric sensor is that it generates a voltage signal in relation to the severity of the impact and does not depend on closing electrical contacts. This analog voltage signal can be filtered for voltage amplitude or frequency. Frequency filtering can remove signals due to vibration, such as from heavy machinery.

Additional applications for the incursion detector are contemplated for safety and security. For example, in one embodiment, the detector is attached to a chain link fence to detect vibration. It can also be attached to equipment or structures at a construction site to detect tampering. A further embodiment is attached to merchandise or merchandise displays to alert store personnel of movement.

Transceiver 54 preferably comprises a low cost radio-frequency (RF) transceiver configured to operate within any desired frequency range. RF sensitivity is preferably on the order of −92 dBm while preferred LF bandwidth should be about 2.5 kHz, with an output power sufficient for the desired range, such as approximately 10 dBm +/−2 dBm. Presently, there are two preferred ranges of frequency: from 260–470 MHz, and from 900–928 MHz. One preferential operating frequency is 433.92 MHz, such as embodied in transceiver model "ATXR-434-ULC Ultra-low Current SAW Transceiver" manufactured by ABACOM™ technologies in Ontario.

Incursion detector 54 may be configured for operation over a single radio frequency and grouped according to a predefined code embedded in the signal. Alternatively, transceiver units may be designed to operate in groups, with each unit group operating on a separate frequency suitable for reception by the incursion receiver unit. It should also be appreciated that multi-channel, broadband, or signal hopping technology may be utilized, as well as other forms of communicating over a distance to a remote annunciating device without departing from the present invention.

The configuration of antenna 56 is generally determined by the intended range and desired directionality of the transmitter unit, along with packaging and reliability considerations. Typically, a non-directional antenna is preferred in that it is not subject to being misaligned with a receiver unit; however, a directional antenna may provide benefits in select applications (i.e. high traffic situation with numerous transmitter-receiver pairs). It should be noted that transmission distance is largely determined by the combination of transmitter output power and the gain of the particular antenna configuration. In one embodiment, the incursion detector unit is configured for a transmission range of approximately 300 feet using a quarter-wave antenna unit, which has a length of around six inches for a 434 MHz transmitter. In another embodiment, the battery power supply is used as the antenna. The antenna, however, may be altered to reduce transmission distance for use in crowded environments, or to increase transmission range if incursion detection is carried out over a larger span between safety icons.

Typical low cost data transmission modules, such as utilizing OOK data encoding, are readily available and provide data at up to about 19.2K baud, which is more than adequate for transferring the necessary alert signals, codes, and other information described herein. The data is preferably encoded following conventional serial communication protocols having at least five bits of encoded information per transmission. It is preferable that the transceiver (or transmitter) unit chosen for this application either be configured to generate alert transmissions which do not require FCC approval, or be pre-approved by the FCC to eliminate the necessity of obtaining FCC certification for the entire incursion detector unit. The transceiver can be further configured to call a cell phone, pager or other receiver with a prerecorded message.

The use of long life primary batteries can provide an inexpensive and readily obtained source of power for the incursion detector units. For example, power may be provided by utilizing primary batteries having a long shelf-life, such as alkaline, lithium, or similar long-life technologies contained within one or more C, M, or AAA size, battery cells. The battery life preferably exceeds approximately 3000 hours and the units should be configured for having negligible power dissipation when not activated. A single battery cell may be utilized for driving low voltage circuitry, or more preferably it may be utilized in conjunction with regulator 58 that provides voltage multiplication, such as derived from one or more stages of switched capacitor voltage doubling.

Power may be alternatively provided with batteries in combination with other forms of power, such as photovoltaic solar cells charging a super capacitor or battery. Other alternative sources of power may also be utilized for providing requisite circuit power. In view of these examples, it should be appreciated that any convenient source of power may be adopted for use within the units without departing from the teachings of the present invention.

A preferred form of power switch (not shown) is activated in response to the ambient light condition measured from a sensor such as a photo sensor or solar cell. In one mode of operation, when the impact detector unit is exposed to a minimum level of ambient light or artificial light, the impact detector unit will activate performing initialization and readying itself to monitor. When the ambient light is below a minimum level for a predetermined interval of time, 24 hours for example, the impact detector unit will shut down all monitoring, except light level, thus preserving battery life. Other means of automatically activating the unit such as optical sensors, tilt sensors, motion detectors temperature sensors, or vibration sensors may be used. In another mode of operation, a further step is used to activate the unit. For example after exposure to light, the unit is subject to a change in orientation or a minimum impact to complete the activation sequence.

Another embodiment (not shown) uses a form of power switch that is activated in response to installation of the incursion transceiver antenna. The presence of an extended antenna can provide a beneficial visible clue that the incursion detector unit is activated, wherein units are less likely to be stored in an ON position thereby depleting battery power. To prevent loss of an antenna after disengagement from the housing, the antenna may be designed to retract, be joined to the housing by an articulated member such as a hinge, or be otherwise configured so that the antenna may be moved from an extended ON position to a substantially recessed, folded-back, or otherwise retained OFF position.

Additionally, it is preferable that incursion detector 22 provide an output means, such as an LED, audio transducer, or similar, for indicating the state of the particular transceiver unit, in particular when power is applied to the unit. By way of example and not of limitation, a bi-color LED may be driven for a short period of time following power activation to indicate unit state and the results from a unit self-test operation.

It will be appreciated that even a single bi-color LED can indicate numerous unit conditions, the following being provided by way of example: (1) displaying a solid green light to indicate a proper operational status; (2) displaying an intermittent green light in response to impact intensity during a portion of the self test so that impact sensor operation is visually verified; (3) displaying an amber light (fast alternating red and green at >30 Hz) for indicating a slightly weak battery; (4) displaying a solid red light to indicate a low battery condition; (5) displaying a flashing red light to indicate circuit failures, such as unable to loop back a transmission from transmitter to receiver, and/or a very low battery condition; (6) displaying a slow alternating red and green light output for a given period of time (i.e. one minute) after registering an incursion level impact to aid in isolating which unit was the source of a given alert signal as received by a area alarm or other receiver unit; (7) upon power up, the absence of light output would indicate that either the battery (or batteries) had discharged below required voltage levels or that the unit is otherwise in a non-operative condition. A legend is preferably provided on the transceiver unit to aid personnel in the interpretation of various unit state annunciation signals which may be generated by the incursion transceiver. The LED is preferably only activated for a limited period of time after power is applied to the unit so as to conserve battery power. In another mode, the LED blinks the status periodically to conserve battery life. It will be appreciated that a number of methods may be utilized for indicating the state of an incursion detector unit prior to, and during, its deployment at a work site without departing from the teachings of the present invention. Another example would be a portable hand held interrogation device, which may be used to indicate complete status of an intrusion transceiver unit when held in proximity to the unit being interrogated.

The circuitry shown is representative of the functions performed within incursion detector 22. It should be appreciated, however, that incursion detector unit 22 may be implemented in any number of ways, such as using discrete elements, custom integrated circuits, programmable logic elements, microcontrollers, other circuit elements and combinations thereof, without departing from the teachings of the present invention.

One preferred method of implementing control circuitry 52 is by utilizing an inexpensive microcontroller, such as a PIC™ microcontroller from Microchip Technology Incorporated® located in Chandler, Ariz. The microcontroller provides data memory (RAM), comparator inputs, embedded identification and/or code programming, and sufficient program memory (ROM, OTP, EPROM, FLASH) for retaining a control program to perform the desired logical functions, the self testing, and for controlling the operation of a transceiver.

Output from impact sensor 50 is received within control circuit 52 by way of conditioning circuit 62 which is configured to condition the signal, such as by pass-band filtering, frequency filtering, voltage filtering and/or signal amplification so as to eliminate unwanted signal noise and to desensitize the circuit to non-alert conditions (i.e. by effectively attenuating the signals associated with non-impact events such as, but not limited to wind or vibrations transmitted from the ground). Conditioning circuit 62 may also be utilized for validating the registered impact, for example by requiring that the impact exceed a predetermined amplitude prior to being registered as an incursion event. It will be appreciated that more complex validation circuits may be alternatively utilized, such as those which incorporate signal processing as may be executed by a microprocessing element, or are processed by means of other circuitry for providing either fixed or adaptable validation conditions.

The impact detection and validation circuitry within incursion detector unit 22 preferably provides the ability to detect the difference between a wind blown disturbance and an impact disturbance. The above sections describe the use of fixed alert thresholds for discriminating impact events. However, it should also be appreciated that impact events may be alternatively registered using variable or adaptable thresholds. For example, the impact signal being generated may be compared to a relative base line impact level (i.e. running average of temporally-local peak impact intensity as generated by wind and other non-impact disturbances) to assure that ambient conditions do not trigger an alert. For example, the processor can determine if sufficient G force change has occurred to constitute an impact, such as 5 Gs, from a base line average of sensed gravity peaks arising from wind gusts. If for example periodic wind disturbances cause gravity response peaks of approximately 1 G, then a registered impact at that time would require 6 Gs before being considered an incursion event. This method allows unit sensitivity to be automatically optimized for different conditions, such as gusty wind conditions, so that false alarms may be prevented without unduly sacrificing sensitivity.

It will be appreciated that numerous additional adaptive evaluation methods and algorithms are known in the signal processing arts which may be utilized herein without departing from the teachings of the present invention.

First and second comparators 64*a*, 64*b* are shown for determining if the signal from the transmitter is of sufficient magnitude to warrant waking up the incursion detector unit, and for detecting low battery conditions. The electrical signals corresponding to impact, low battery, and receiver activity are shown connected to a three input "OR" gate 66 whose output is shown driving a wakeup signal. A signal decoder section 68 provides for decoding signals from the receiver portion of transceiver 54 and determining whether or not the received incursion alert should be retransmitted. A message selector 70 provides a message selection means that is responsive to events within the device, or received from other devices. The logic within message selector 70 determines what, if any messages, are to be transmitted, such as transmitting an incursion alert from this unit, retransmitting an incursion alert signal received from another unit, transmitting a low battery condition, transmitting results during a self-test mode, transmitting a tipping signal and other possible message states. It should be recognized that a number of different messages may be encoded and communicated by each incursion detector unit to one or more incursion receivers.

A code section 72 is configured as a means for generating a predetermined data or group code within the transmitted alert signal. The code provides information about the transmitting source such as a unit identifier, a unit type specifier, or a transmitter group designation to be encoded into the transmissions. These codes can facilitate the proper processing of signals by incursion receiver units, such as the personal receivers 25 shown in FIG. 1.

By way of example, assume a first group and a second group of transceivers are each set for encoding a different group code. The first group of transceivers may be setup at the work site associated with a first direction of traffic, while the second group of transceivers may be setup associated with a second direction of traffic. The incursion receiver, or receivers, may be configured for generating an annunciation for either direction, both directions equally, or for generating different annunciations depending on direction. Additionally, different incursion receiver units may be utilized for the first and second groups without confusion. Furthermore, the groups may be setup at different distances from a work site (i.e. first group from over 300 feet to 100 feet, second group spanning the last 100 feet) to provide different intensity annunciations with respect to distance. Accordingly, it should be appreciated that code based encoding may be utilized to provide any desired segmentation of the alert signal without departing from the present invention.

A signal encoder section 74 (or encoder) provides for incorporating (encoding) the codes and messages within a transmission by transceiver 54. In a preferred implementation, signal encoder 74 combines the value from the message selection logic with an embedded code to form the data to be transmitted. The embedded code preferably comprises a unique or semi-unique identifier, type code, or group code programmed into a microcontroller or other element able to retain coded data for transmission.

Each incursion detector unit 22, upon transmitting an alert, preferably locks out its receiver for a period of time, such as from approximately 0.5 to 15 seconds, and more preferably for about 2 seconds to about 10 seconds, to prevent continuous alert transmissions from being generated. It will also be appreciated that more frequent alerts and false alerts would typically prove to be more annoyance than benefit in a work zone.

Incursion detector unit 22 may be implemented with a number of alternative configurations and utilized in various ways. The following information is provided by way of example illustrating a few of the contemplated variations. The use of just incursion transmitters may be utilized instead of transceivers if the distance to the incursion receiver units is less than the transmission range of the transmitters. However many situations arise that require extending the operating distance beyond this nominal range. The advantage of the present invention is one or more repeater units (transceiver units or discrete receivers coupled to the transmitters) may be positioned for optimum coverage when setting up the safety icons including coverage for blind spots and curves. Furthermore, the incursion detection transceivers can be adapted for the attachment of various configurations of antenna to alter the gain and thereby to control the transmission range. Similarly, the antenna within the area alarm may be adjusted or replaced to suit the distance over which coverage is desired.

Other embodiments of the incursion detectors are contemplated, for example, an embodiment may be implemented in which the transmitted message may include a severity code in response to the extent of the impact being registered. Encoding of severity can provide different forms of annunciation, for instance, in response to a backhoe working at the site gently bumping a traffic cone, as contrasted with a speeding vehicle overrunning a set of traffic cones as it careens toward a road crew. The type and intensity of alert annunciation may also be fully or partially responsive to the encoded value for unit type, group, and so forth as described earlier. Additionally, the annunciation severity may increase upon registering a subsequent impact by a second transceiver unit, after that second unit received the signal from the first transceiver unit. In this way a slight incursion of a vehicle with a single safety icon may be differentiated from an out of control vehicle that is crossing over a series of safety icons. Furthermore, receiver units may be configured to generate an annunciation whose characteristics are varied in response to the distance from the incursion transmitter generating the alert. It will be recognized that this approach allows communicating additional information to aid the work party in ascertaining risk factors.

Figure 3:
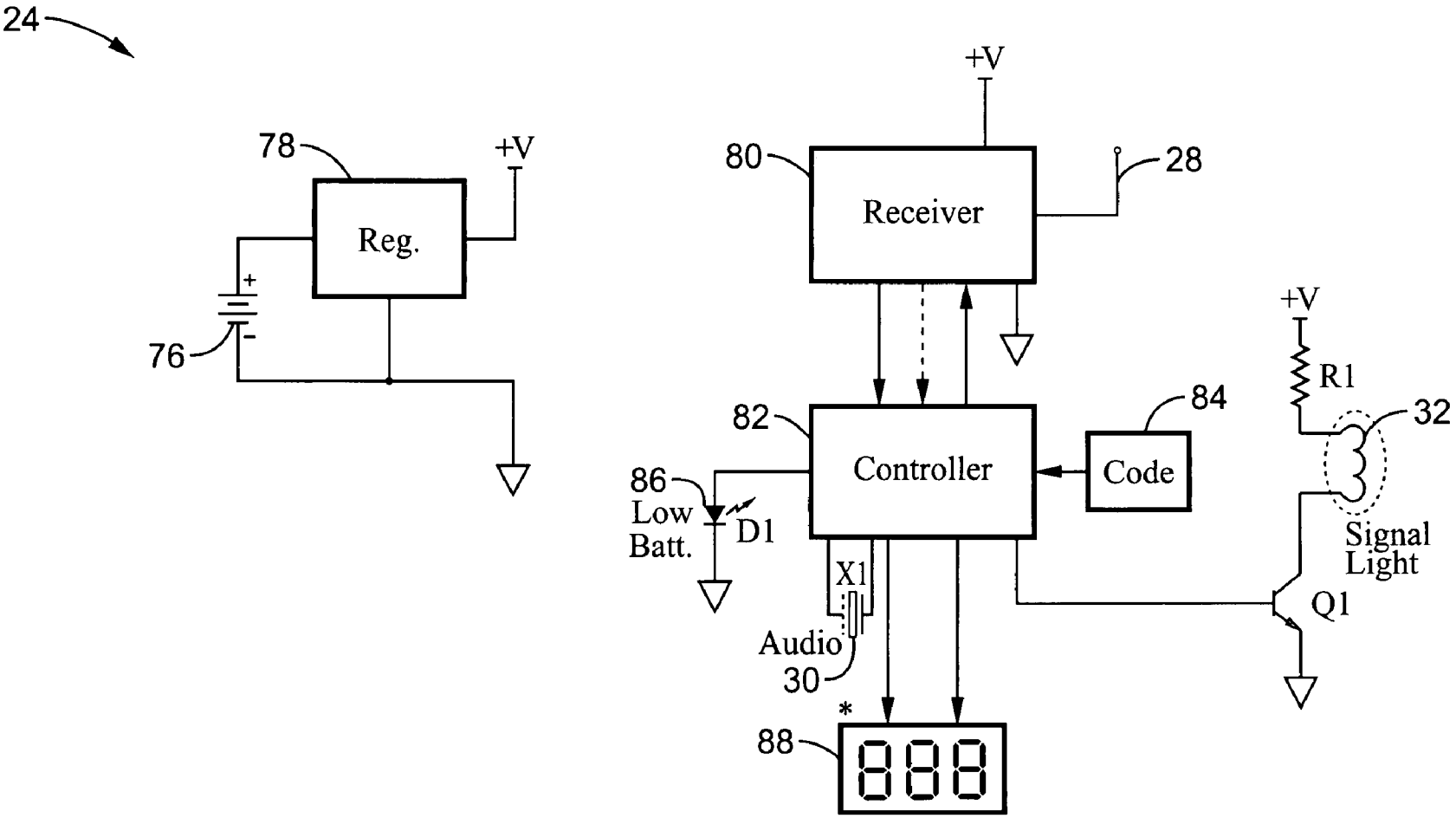
FIG. 3 is a block diagram of an incursion receiver according an embodiment of the present invention, shown configured for activating an audio transducer and a signal light in response to received alert conditions.

FIG. 3 exemplifies a simple embodiment of an incursion receiver unit 24. It should be appreciated that numerous forms of receiver devices may be designed or modified for use with the incursion detectors of the present invention. The figure exemplifies one such receiver unit that converts radio frequency alert signals received from incursion transceivers into an annunciation of sufficient intensity to alert personnel in the area surrounding a area alarm unit, or other area alerting receiver. Alternatively, receiver unit 24 may be implemented as a personal alert device, such as for incorporation within headsets, pagers and the like. Incursion receiver unit 24 is shown for providing both audio and light output, although other forms of feedback may be additionally or alternatively provided, such as physical output (i.e. "pop-up" flags, and so forth), or vibratory feedback that by way of example may be generated by activating an off-balance electrical motor in a similar manner to those utilized in personal pagers.

Incursion receiver unit 24 is exemplified with a self-contained source of power, such as battery 76 and a power regulator 78, although it will be appreciated that power may be alternatively provided by other sources of power, including existing power supplies within vehicles or other equipment. A receiver circuit 80 connected to receiver antenna 28 is configured for receiving the RF transmissions, from one or more of the incursion transceiver units, and communicating that received information to a controller 82.

Incursion receiver unit 24 may be implemented as an area alerting device (i.e. area alarm) for alerting a group of persons within the vicinity, or as a personal alert device which is retained proximal to one or more individuals. For example, an area alert device may be mounted on a stand or otherwise positioned to increase visibility and to promote optimum sound disbursement. It should also be appreciated that newer phased sound generation techniques may be utilized as desired for directing sounds along specific directions from either area alert devices or personal alert devices. Personal alert devices may be implemented in a number of ways, two preferred forms being a headphone and pager style units. The personal headphone device attenuates work site related noise, while still annunciating alerts within the ear cups, or ear bud, in response to receipt of radio transmitted incursion events. A personal alert device may also be implemented in a configuration similar to a personal pager unit that generates sound, optional light output, or vibratory feedback in response to an alert being received. Any form of personally carried alert device may also be configured for generating an area alert. It should also be appreciated that these approaches may be combined to suit any specific construction situation depending on the operations performed and the anticipated ambient conditions.

The incursion receiver unit may be designed to indiscriminately respond to all valid codes, and/or frequencies, by generating an alert annunciation. Alternatively, a code or set of codes may be adjusted on a code input selector or encoder 84 to select which unit code, group codes or frequencies to which the receiver will respond. Although a typical system setup may involve generating an alert in response to a single set of incursion detectors, it should be appreciated that multiple sets of incursion devices may be utilized for indicating different directions, distances, and so forth. Additionally, by allowing all valid codes or multiple codes to be set within an incursion annunciating receiver, such as the area alarm, added flexibility is provided as transceiver units may be employed at a work site that span multiple group codes. Optionally, the unit may generate different annunciations in response to the different codes. For example, transceivers with a first code may be set up at a distance and the receiver set to generate a first tonal pattern and medium intensity output in response. A second set of transceivers with a second code may be set up on closer approach to the work site, wherein the receiver may be set to generate a second tonal pattern and higher intensity output in response. In this way the present system may be utilized so that it generates any desired set of annunciated responses suitable to the situation being registered.

Annunciations within incursion receiver unit 24 are generated as exemplified by speaker 30 in combination with signaling light 32. The annunciating device preferably enters an idle mode for a predetermined period of time after signaling an alert to prevent redundant alerts. Various forms of annunciation may be provided by the incursion receiver, such as acoustic output, physical output, and/or light output may be provided such as incorporating haptic feedback within personal receiver units (i.e. headphones or pager style units) mounted to an individual (not shown). Incursion receiver unit 24 when configured to generate an wide area acoustic alert may be referred to as a "whooper", "horn alert" or similar terms.

Optionally, incursion receiver 24 can be configured for displaying and/or annunciating additional information. By way of example, a low battery indicator 86 is shown for indicating the state of the power source for the incursion receiver unit 24, and alternatively for indicating low battery conditions on activated transceiver units. The status of the receiver and or the associated transceivers may also be indicated using a display 88, shown as a simple seven segment LCD display unit, wherein information such as group codes may be conveyed to and from the users. Furthermore, inputs may be provided for the receiver, such as discrete buttons, switches, keypads, and the like, to set the modes and operating characteristics of the incursion detector unit.

In another embodiment of the invention, a module with receiver 80 and controller 82 is coupled directly to incursion unit 24 so that incursion unit 24 will provide a visual and/or audio alert upon detecting an impact or receiving an impact alert signal.

Figure 4:
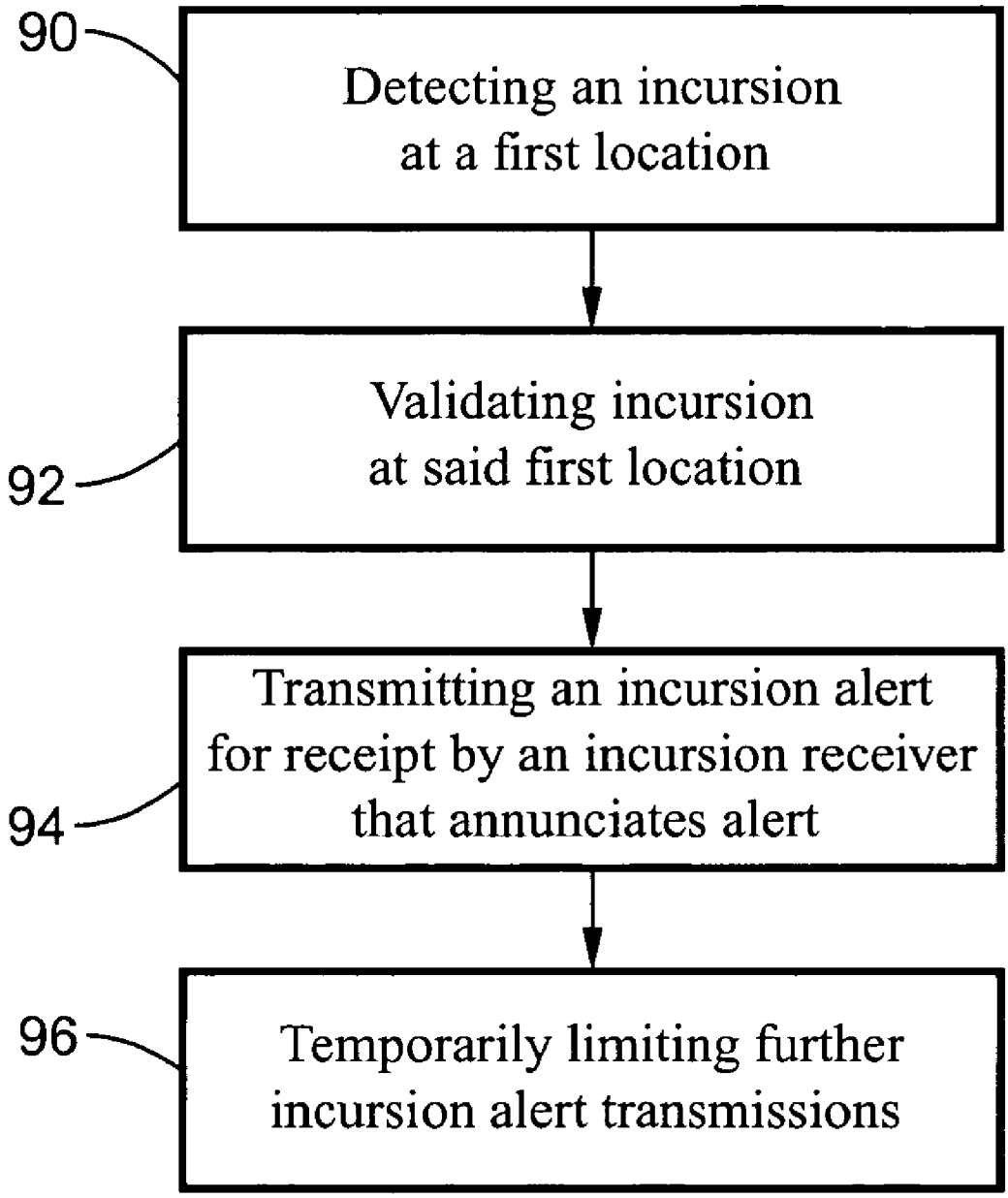
FIG. 4 is a flowchart of system operation for an embodiment of the incursion alerting system according to the present invention.

FIG. 4 exemplifies the method of operation for the incursion alert system of the present invention. An incursion is detected at an incursion detector (or transceiver) as represented by block 90 and validated at block 92 to assure that wind, temperature, tipping or other non-hazardous situations do not result in alert generation. Validated incursions are then transmitted as depicted by block 94 for receipt by an incursion receiver configured to alert personnel to the incursion by annunciating the alert using light, sound, haptic output, or combinations thereof. Once an alert is sent by an incursion transceiver, the transceiver preferably enters a temporary transmission lockout period, as represented by block 96, to prevent continuous alert generation from occurring. It will be appreciated by one of ordinary skill in the art that other mechanisms may be alternatively utilized for breaking the feedback situation that may otherwise lead to continuous alerts being generated.

In one method, two detection protocols are used. In the impact protocol, an impact is detected alone or prior to a tilt detection. The impact signal is processed to the transceiver for transmission and then the lockout period will commence at the conclusion of the transmission, preferably for about 10 seconds. In the tilt protocol, a tilt signal is detected first with or without an impact detection, such as a safety icon tipping over due to wind. No signal is processed to the transceiver in this protocol. A lock out period, say about 10 seconds, is entered to allow disruptions to settle before allowing further detection and transmissions.

Figure 5:
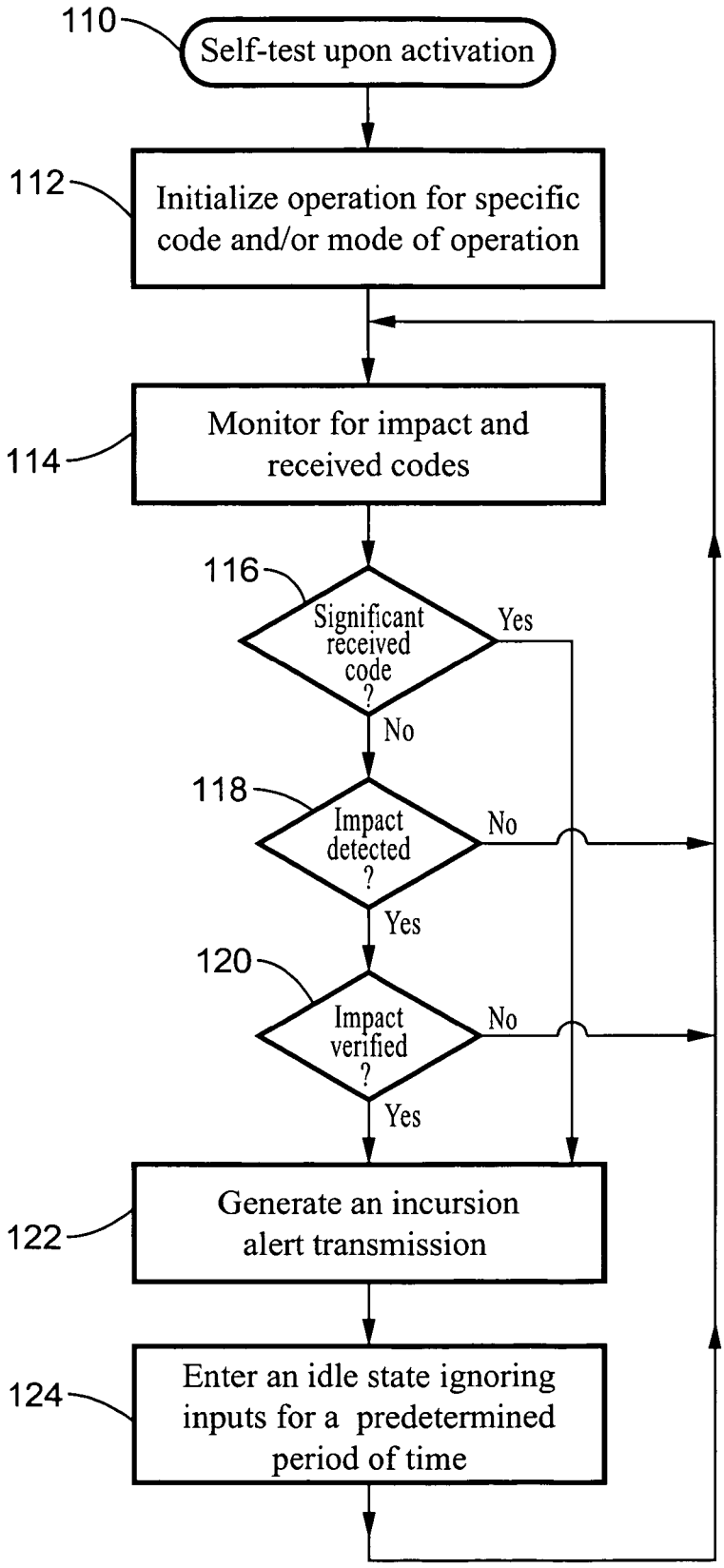
FIG. 5 is a flowchart of operation for an embodiment of the incursion detector according to the present invention.

FIG. 5 exemplifies the operation of a control program executing within the controller of an incursion detector unit. Upon power up, a unit self-test is performed as represented by block 110, followed by initialization of the unit and performing any needed configurations prior to entering an operational state. It is preferred that the initialization phase of the transceiver span a period of time on the order of from two seconds to twenty seconds, so that the transceiver unit does not generate an alert while being activated and positioned upon a roadway icon. A self-test sequence need not be incorporated within the transceiver units, however, its inclusion can easily increase the reliability of incursion detection as setup at a work site.

In one embodiment, the incursion unit has an automatic light sensor in the form of a photo sensor, photo cell or solar cell. The light sensor will power down the incursion unit when exposed to a 24 hour period of darkness, such as placed in a closed storage container. When the incursion unit is removed from the storage container and the light sensor detects artificial or natural ambient light, the incursion unit will power on automatically. In one mode of this embodiment, the power up sequence also requires the incursion unit to be rotated sufficiently to activate the tilt sensor. This will initiate the self test and the LED will indicate functioning circuitry and a good battery by flashing green. Once the LED indicates green, the incursion unit is enabled for impact detection after a predetermined period of time, for example about 10 seconds, to enable deployment without an accidental alert. This power up sequence prevents accidental activation by exposure to light or accidental deactivation by an on/off switch. In another mode, the LED blinks red for low battery and does not light if there is a malfunction.

Once operational, the incursion detector monitors for impacts and coded alerts received from other transceiver units as represented by block 114. In one operational mode, the incursion unit polls at a low clock speed (such as 32.767 KHz) to monitor the battery, sensors and activate the LED when appropriate. The transceiver is not active during this polling period that lasts several milliseconds. Then the processor shifts to a high clock speed (such as 4 MHz) and activates the transceiver in receiver mode. After a delay to provide stability, the receiver is capable of receiving a data signal and sending it to the processor. If a coded alert is received, as detected by block 116, then the unit generates an incursion alert as per block 122, by retransmitting the alert with the proper code setting. If a coded alert is not received, a check for a sufficient impact intensity is performed at block 118, which upon being satisfied is verified at block 120. Verification can be provided by filtering predetermined ranges of signal voltage and/or filtering selected signal frequencies. If the coded alert is not valid, it will be ignored and the incursion unit will reenter the polling mode at the low clock speed.

Signals from a tilt sensor or other sensor input can be used alone or in combination with other signals to validate an impact signal. For example, in one embodiment, a signal from a tilt sensor immediately prior to an impact signal from the impact detector will signify a tipping event and no alert signal will be transmitted. Upon verifying impact, a message is communicated by way of an alert transmission represented at block 122 to other incursion units and to personal receivers or an area alarm if it is within transmission range.

In another mode, the incursion unit can verify a group code coupled with the received alert code. Group codes can be encoded permanently into an incursion receiver and designated, for example, by the color of the incursion unit housing. In another mode, a group code can be encoded into an incursion unit with an internal dip switch or an EPROM. In this mode, if an incursion unit receives an alert signal not in its selected group, it will ignore the alert signal and not retransmit. This situation could apply where two groups are positioned in close proximity, such as on each side of a roadway.

In a further mode, a low battery alert signal can be generated in an incursion unit and transmitted to other incursion units or the remote receiver. This battery alert signal would be annunciated differently than an impact alert such as with a lower volume beep or flashing light. The low batter alert can be limited to incursion receivers in the same group code.

Typically, the transmissions from an incursion detector (or transmitter) will be directly received by an associated master or personal receiver, however, this can not be assumed as in many situations a remote safety icon may be located outside of the direct reception range of the area alarm. Insufficient range typically arise as a result of obstacles being located or positioned between the incursion transmitter and receiver, for example terrain, vehicles, or worksite equipment. After generating an alert, the transceiver unit enters a mode to prevent continuous alerts, depicted by entering an idle state as per block 124, thereby allowing all transmitters to return to idle mode prior to a subsequent alert being generated. In one embodiment, this idle state is about 10 seconds.

It should be appreciated that alternative or additional forms of incursion sensing may be utilized to suit a variety of applications. For example, additional physical and/or sensing elements may be utilized with an incursion unit to extend its physical incursion sensing range. Incursion may be detected in the space between safety icons (i.e. traffic cones or posts) by connecting a safety icon, by either a physical or non-physical connection, to a transceiver unit. It will be appreciated that ropes, nets, gates, and other physical structures may be attached between an incursion unit to a fixed point or to another incursion unit. Impact with the physical extensions is physically transmitted to the incursion detection transceiver and communicated to the remote receiver device.

Furthermore, additional sensors may be fitted to the incursion detector to allow detecting incursion over a large area, such as by utilizing pressure sensitive extension tubes, or pads, that sense pressure as would occur when a car attempts to drive between safety icons. One embodiment of these could be implemented in a similar form factor as a Bot's dot, wherein it transmits an incursion alert in response to being driven over. The embodiment may be implemented by incorporating a flexing piezoelectric element for generating operating power to an encoder and transmitter in response to the flexure of being driven over. It will be noted that although the unit may be self-powered in response to an incursion, it would generally require an additional or different power source if alert signal repetition is desired.

Figure 6:
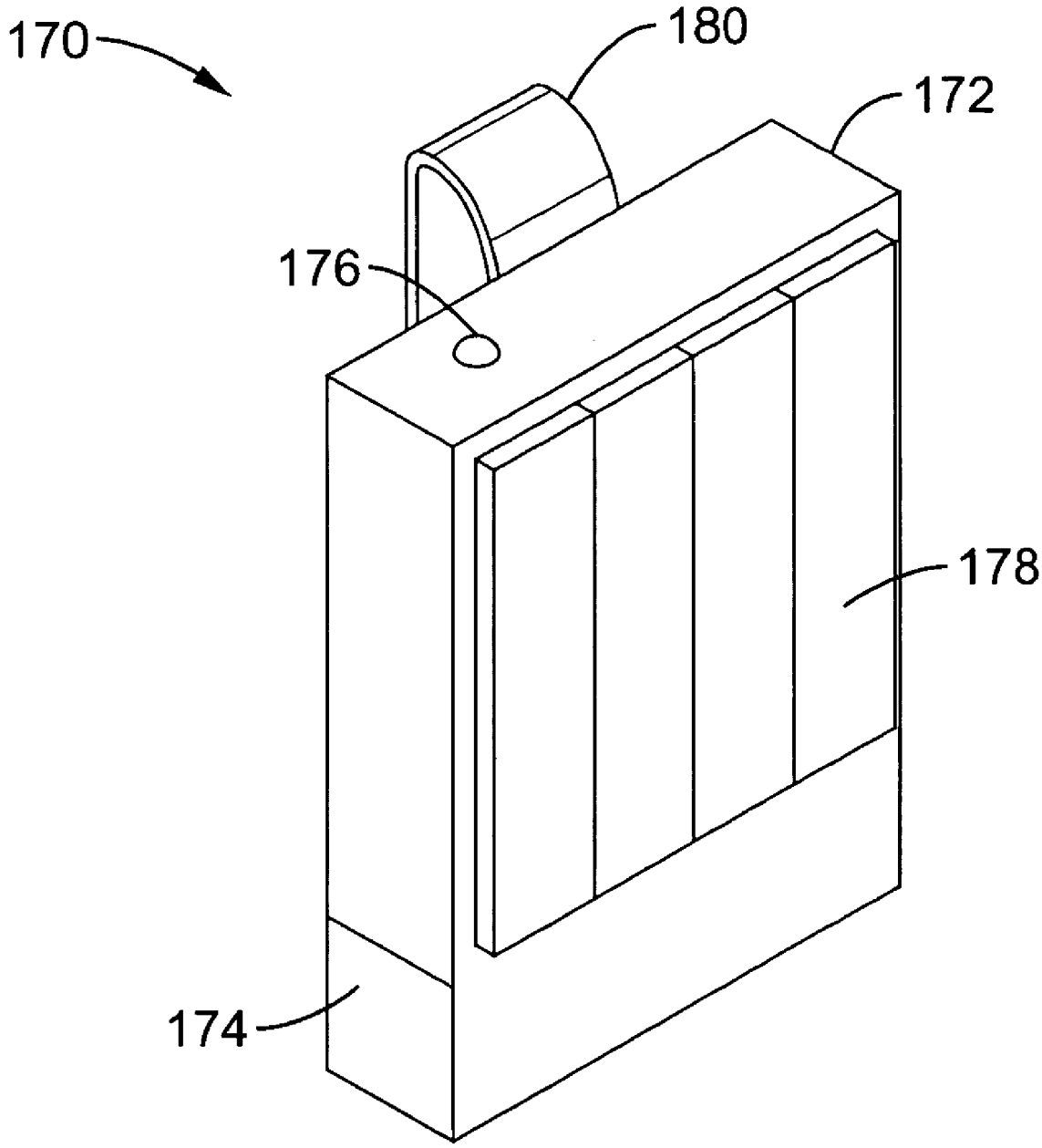
FIG. 6 is an perspective view of an embodiment of an incursion detector.

FIG. 6 illustrates another embodiment of an incursion alert detector 170 using a piezoelectric impact sensor (not shown) and a tilt sensor (not shown). Housing 172 is made of a durable weather resistant material, such as plastic, and houses circuitry described in FIG. 2. Housing 172 can be color coded to designate a particular preprogrammed group code and in a preferred embodiment, up to five group codes are designated. Battery door 174 allows access for replacement and maintenance of batteries (not shown). A multicolor LED 176 is located at a convenient location to provide operational status of the incursion alert detector 170 as described in FIG. 2 and status of batteries (not shown). In a further embodiment, an LCD screen (not shown) is used to convey operational information. In another embodiment, a pop-up button (not shown) is used to signal low batteries. In a further embodiment, a detent button (not shown) is provided for temporarily handling the incursion alert detector without accidentally transmitting an incursion alert. In another embodiment, a test button (not shown) is provided to test the sensor and circuitry without transmitting an incursion alert. Solar cell 178 is coupled to housing 172 and provides a daytime energy source as well as a sensor for automatically activating incursion alert detector 170 when exposed to ambient or artificial light. Other means for automatic activation such as a tilt switch, motion sensor, temperature sensor photo sensor or vibration sensor may also be used. A clip 180 is provided to detachably couple the incursion alert detector 170 to a safety icon as shown in FIG. 1. Other means of attachment such as straps, harnesses and hook and loop fabric (not shown) are used to detachably couple incursion alert detector 170 to safety icons. In a further embodiment, an external antenna (not shown) may also be provided to increase range and signal strength.

The incursion detector 170 uses a light sensor such as a solar cell 178 to determine when it is in storage on not in storage for the purpose of turning on and off the incursion detector. When the sensor shows darkness for 24 hours such as being in its storage container the incursion detector 170 will power down to its best power saving mode while still allowing the light sensor to be monitored. There is no ON/OFF switch for the worker to deal with.

When incursion detector 170 is removed from the storage container and solar cell 178 sees either artificial or natural light of sufficient intensity the incursion detector will start the power up and initialization sequence. This sequence will determine deployment capability, arm sensors and start the polling sequence depending on the status of certain monitored features.

In one embodiment, upon power up by light activation, there is a sequence required in order for the incursion detector to be deployed. After removing the incursion detector from the storage container, the worker must tilt the incursion detector from about 70 degrees to about 180 degrees to activate the tilt sensor and watch the LED indicator 176. If the LED 176 shows green, the battery is good and the incursion detector is OK for deployment. If the LED 176 is red or unlighted then the incursion detector is not ready for deployment. No protection features will be enabled. The incursion detector will arm itself after a predetermined time. The LED 176 will indicated only during this delayed time.

Accordingly, it will be seen that this invention provides a method for generating alert annunciations to personnel at a roadside construction site, or similar location, in response to incursions or other impact related events. Further, the invention provides a method for validation and repetition of the alert signal.

Figure 7:
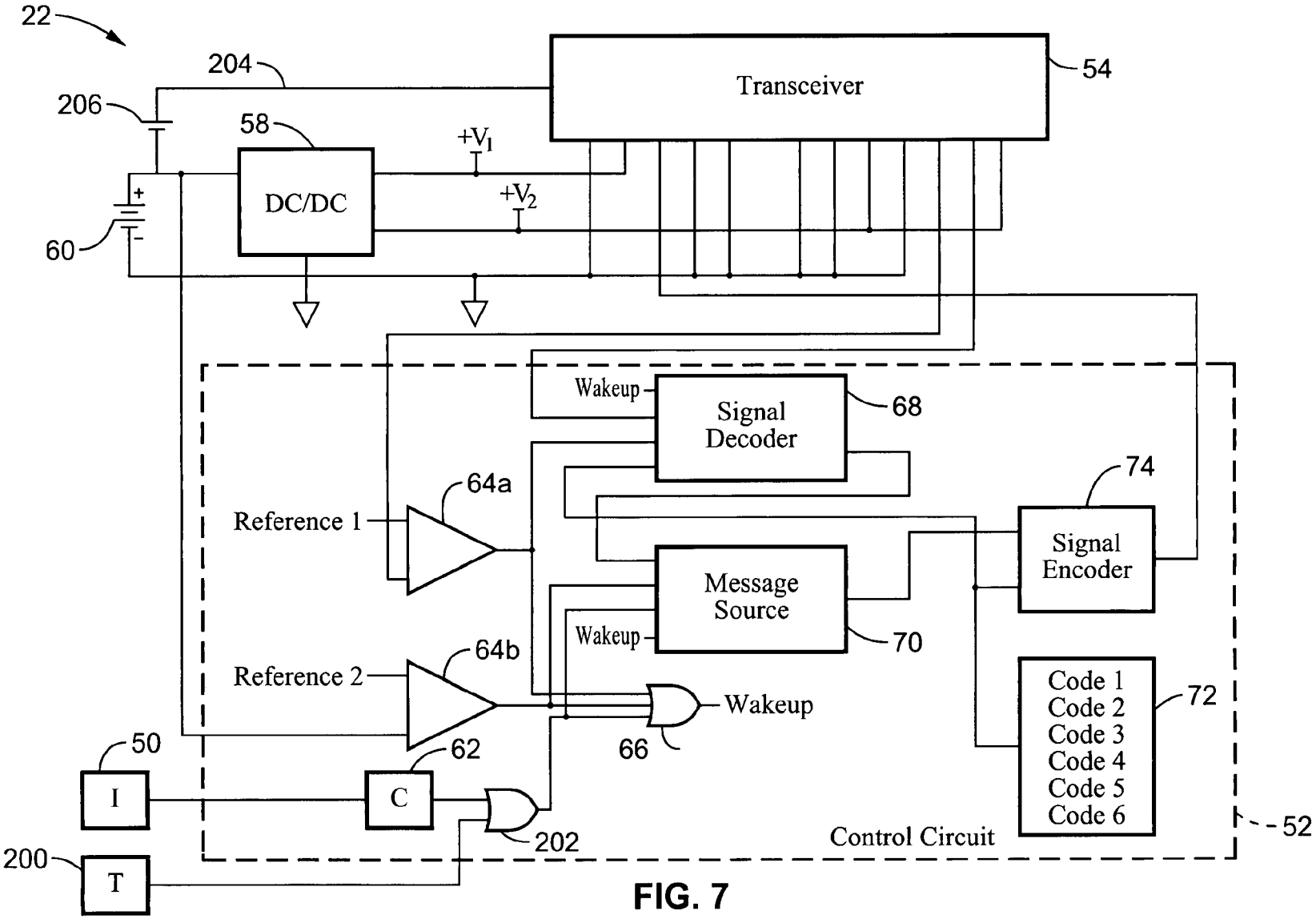
FIG. 7 is a simplified schematic view of another embodiment of an incursion receiver as shown in FIG. 2.

FIG. 7 illustrates a schematic view of another embodiment of an incursion detector shown previously in FIG. 2 and according to the invention. Tilt sensor 200 is connected to control circuit 52 through gate 202 so that a wake up signal will occur from either impact sensor 50 or tilt sensor 200.

There are two operational protocols; the impact protocol and the tilt protocol. Under the impact protocol, the impact sensor 50 has been determined to have activated first. The incursion detector will discontinue all other tasks and process the impact. Processing the impact means transmitting a unique code out via the RF transceiver 54. The unique code consists of an impact code attached to a group code. Once the transmission is complete the incursion detector will enter a hold mode for 10 seconds and allow no protection features to operate for those 10 seconds. Under the tilt protocol, the tilt sensor has been determined to have activated first. All other features are put on hold for 10 seconds to allow time for the incursion detector disruption to settle. No codes are transmitted for a tilt only detection.

The impact and tilt sensor features are activated based on the order of detection of the impact sensor 50 and the tilt sensor 200. If the tilt is sensed before and impact or the tilt is sensed without an impact then we have detected a "tipover" and not an "impact" and the tilt protocol is activated. If the impact is sensed before a tilt or an impact is sensed without a tilt then we have detected an "impact" and not a "tipover" and the impact protocol is activated.

There are from about three to about six or more distinct codes to allow differentiation of protected areas and is up to the user to determine need. These are preprogrammed at time of manufacture and related via color coding of the incursion detector housing.

The incursion detector battery level is monitored at **64*a*** and is determined to be at end of life with approximately 72 hours of life left. This covers the 48 hour of dead use time over a weekend. A low battery warning code is sent at a periodic interval to be annunciated from the wide area alarm in such a way as not to be confused with a true alert. The low battery code consists of a low battery code attached to a group code.

In this embodiment, the positive terminal of battery 60 is coupled to the RF output of transceiver 54 through capacitor 206 and battery 60 functions as the antenna. The battery is cylindrical thus allowing the incursion detector to transmit omni directionally.

Once the incursion detector is initially deployed, the unit will arm the sensors after a predetermined time in seconds. This allows the incursion detector to not be activated via the act of deployment of other incursion detector's.

An LED (not shown) is used to provide visual indication of specific conditions of the incursion detector. When lighted green the incursion detector is in good condition. When lighted red the incursion detector battery is low. When not lighted the incursion detector is not working. The LED blinks at slow rate when indicating.

Polling mode is the primary operating mode of the incursion detector. The incursion detector processor is normally in a low clock speed (such as 32.767 KHz) mode and monitors the battery and sensors and also runs the LED when indication is required. The transceiver is not active in any mode during this time. After several milliseconds the processor will switch into high clock speed (such as 4 MHz) and activates the transceiver in receive mode. After a delay to provide stability the receiver will start receiving a data signal to the processor. The data signal is processed to determine if it is going to be a valid signal. If it is determined it is going to be a valid signal the processor will completely receive the remaining signal, extract and decode. The extracted code will determine the next process. If it is a valid impact code and it is an impact within its group, then it will encode and retransmit the same code for other incursion detector's to receive and retransmit. If it is a battery low code in its own group then it will encode and retransmit the same low battery code for the other incursion detector's to receive and retransmit to be annunciated at the wide area alarm. If any signal received is not within its group, it will be ignored and the incursion detector will be reset. If the signal is determined it will not be valid, the incursion detector will reenter the polling mode at the low speed clock.

Figure 8:
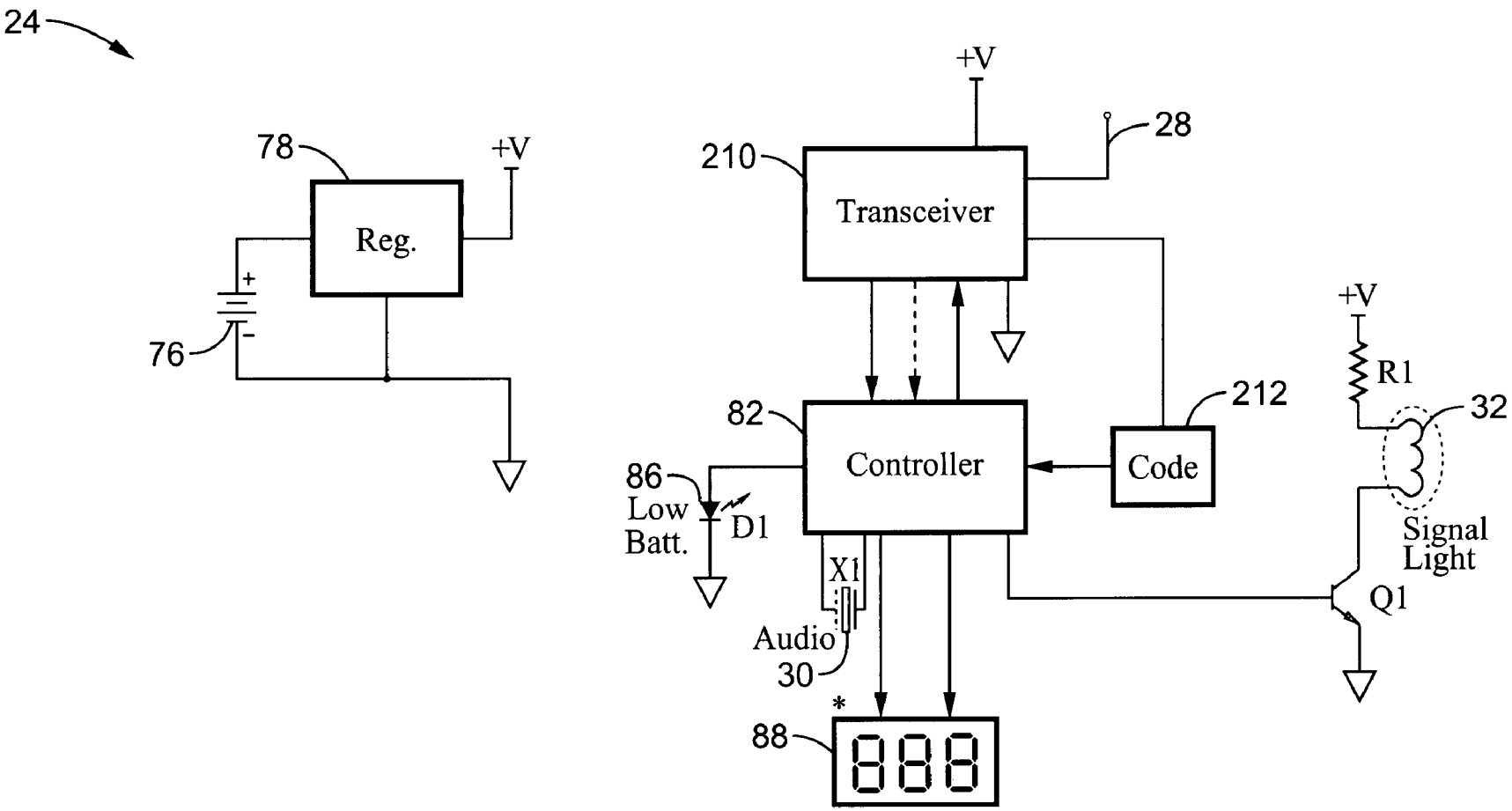
FIG. 8 is a block diagram of another embodiment of an incursion receiver as shown in FIG. 3.

FIG. 8 illustrates a block diagram of another embodiment of an incursion receiver shown previously in FIG. 3 and according to the invention. A transceiver 210 is used to receive alert and status signals and described previously in FIG. 3. The area alarm version is configured to receive an interrogation signal from a personal receiver and transmit the current group code setting from block 212 through transceiver 210. Personal receiver versions are configured to interrogate an area receiver through transceiver 210 and receive the current group code which is registered into block 212. The interrogation is initiated manually by the user, such as pushing a button, and an audio or visual signal is issued when the group code is registered.

In one embodiment a code or set of codes is programmed into a personal receiver by interrogation of an area alarm by the personal receiver. The user of the personal receiver when in close proximity to the area alarm presses and holds a button on the receiver. The personal receiver will then acknowledge the valid code has been saved in memory via an audible signal to the user. This also allows a user to move from one alert area with one group code to another alert area with a different group code and quickly change and verify the correct group code in their personal receiver.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for detecting an incursion event and alerting a receiving device, comprising:

an impact detector adapted to detect an incursion event and generate an impact signal;

means for transmitting an alert signal to a receiving device in response to detection of an incursion event by said impact detector; and means for automatically activating said impact detector in response to a change in ambient light;

wherein said impact detector cannot be switched off for a predetermined interval of time after activation by said means for automatically activating.

2. An apparatus as recited in claim 1, wherein said means for automatically activating comprises a photo sensor.

3. An apparatus as recited in claim 1, wherein said means for transmitting comprises:

a validation circuit adapted to receive said impact signal from said impact detector and verify that an impact corresponding to an incursion event has occurred;

wherein said validation circuit is further adapted to generate an alert signal when an incursion event has occurred; and a transmitter connected to said validation circuit;

wherein said validation circuit is further adapted to communicate said alert signal to said transmitter for transmission to a receiving device.

4. An apparatus as recited in claim 3, further comprising:

a battery coupled to said impact detector;

wherein said battery functions as an antenna for said transmitter.

5. An apparatus as recited in claim 3, said means for transmitting further comprising:

a forwarding receiver adapted to receive an alert signal from another alert apparatus and communicate said alert signal to said transmitter for transmission to a receiving device.

6. An apparatus as recited in claim 5, said means for transmitting further comprising:

an encoder coupled to said validation circuit;

wherein said encoder is adapted to encode said alert signal from said validation circuit.

7. An apparatus as recited in claim 3, further comprising:

a tilt sensor connected to said validation circuit;

wherein said tilt sensor is adapted to detect a change in orientation of said impact detector.

8. An apparatus as recited in claim 7, wherein said validation circuit will not generate an alert signal when a change in orientation is detected by said tilt sensor immediately prior to an impact detected by said impact detector.

9. An apparatus as recited in claim 7, said means for transmitting further comprising:

a forwarding receiver adapted to receive an alert signal from another alert apparatus and communicate said alert signal to said transmitter for transmission to a receiving device.

10. An apparatus as recited in claim 9, further comprising:

a battery coupled to said impact detector;

wherein said battery functions as an antenna for said transmitter.

11. An apparatus as recited in claim 3, wherein said impact detector comprises a piezoelectric sensor that generates a voltage signal in response to an impact.

12. An apparatus as recited in claim 11, wherein said validation circuit comprises:

a voltage threshold filter that is adjustable and configured for selectively filtering non-impact signals from said piezoelectric sensor; and a frequency filter that is adjustable and configured for selectively filtering non-impact signals from said piezoelectric sensor of a predetermined frequency.

13. An apparatus as recited in claim 12, further comprising:

a tilt sensor connected to said validation circuit;

wherein said tilt sensor is adapted to detect a change in orientation of said impact detector.

14. An apparatus as recited in claim 13, wherein said validation circuit will not generate an alert signal when a change in orientation is detected by said tilt sensor immediately prior to an impact detected by said impact detector.

15. An apparatus as recited in claim 1, wherein said impact detector is adapted to attach to a safety icon selected from the group consisting essentially of traffic cones, traffic posts, safety barricades, safety barrels, safety nets, attenuators, pylons and safety fences.

16. An apparatus for detecting an incursion event and alerting a receiving device, comprising:

an impact detector adapted to generate an impact signal in response to detecting an incursion event;

a validation circuit adapted to receive said impact signal from said impact detector and verify that an impact corresponding to an incursion event has occurred;

wherein said validation circuit is further adapted to generate an alert signal when an incursion event has occurred;

a transmitter connected to said validation circuit;

wherein said validation circuit is further adapted to communicate said alert signal to said transmitter for transmission to a receiving device; and a tilt sensor connected to said validation circuit;

wherein said tilt sensor is adapted to detect a change in orientation of said impact detector; and wherein said validation circuit will not generate an alert signal when a change in orientation is detected by said tilt switch immediately prior to an impact detected by said impact detector.

17. An apparatus as recited in claim 16, further comprising:

an automatic activation switch coupled to said impact detector;

wherein said automatic activation switch is responsive to ambient light; and wherein said impact detector cannot be switched off for a predetermined interval of time after activation by said automatic activation switch.

18. An apparatus as recited in claim 17, wherein said automatic activation switch comprises a photo sensor.

19. An apparatus as recited in claim 16, wherein said impact detector comprises a piezoelectric sensor that generates a voltage signal in response to an impact.

20. An apparatus as recited in claim 19, said validation circuit comprises:

a voltage threshold filter that is adjustable and configured for selectively filtering non-impact signals from said piezoelectric sensor; and a frequency filter that is adjustable and configured for selectively filtering non-impact signals from said piezoelectric sensor of a predetermined frequency.

21. An apparatus as recited in claim 16, further comprising:

an encoder coupled to said validation circuit;

wherein said encoder is adapted to encode said alert signal from said validation circuit.

22. An apparatus as recited in claim 16, further comprising a forwarding receiver adapted to receive an alert signal from another alert apparatus and communicate said alert signal to said transmitter for transmission to a receiving device.

23. An apparatus as recited in claim 16, further comprising:

a battery coupled to said impact detector;

wherein said battery functions as an antenna for said transmitter.

24. An apparatus for alerting personnel to an incursion event, comprising:

an impact detector adapted to generate an impact signal in response to detecting an incursion event;

a validation circuit adapted to receive said impact signal from said impact detector and verify that an impact corresponding to an incursion event has occurred;

wherein said validation circuit is further adapted to generate an alert signal when an incursion event has occurred;

a transmitter connected to said validation circuit;

wherein said validation circuit is further adapted to communicate said alert signal to said transmitter;

a tilt sensor connected to said validation circuit;

wherein said tilt sensor is adapted to detect a change in orientation of said impact detector;

wherein said validation circuit will not generate an alert signal when a change in orientation is detected by said tilt switch immediately prior to an impact detected by said impact detector; and a personal receiver adapted to receive a coded alert signal from said transmitter;

wherein said personal receiver is further adapted to annunciate an alert when said coded alert signal is received from said transmitter.

25. An apparatus as recited in claim 24, further comprising:

an area alert receiver adapted to receive a coded alert signal from said transmitter;

wherein said area alert receiver is further adapted to annunciate an alert when said coded alert signal is received from said transmitter.

26. An apparatus as recited in claim 25, further comprising:

a first transceiver coupled to said personal receiver;

a second transceiver coupled to said area alert receiver;

wherein said first transceiver is adapted to interrogate said second transceiver in said area alert receiver; and wherein said second transceiver is adapted to respond to interrogation from said first transceiver in said personal receiver with a code for said coded alert signal.

27. An apparatus as recited in claim 26, wherein said personal receiver is configured to receive said coded alert signal from said transmitter after receiving said code from said area receiver.

* * * * *